US007654832B2

(12) United States Patent
Kohorst

(10) Patent No.: US 7,654,832 B2
(45) Date of Patent: Feb. 2, 2010

(54) DOUBLE-ROW ANGLE PIN CONNECTOR

(75) Inventor: Berthold Kohorst, Vechta (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 11/996,153

(22) PCT Filed: Jul. 3, 2006

(86) PCT No.: PCT/DE2006/001152

§ 371 (c)(1),
(2), (4) Date: Jun. 12, 2008

(87) PCT Pub. No.: WO2007/009421

PCT Pub. Date: Jan. 25, 2007

(65) Prior Publication Data

US 2008/0311799 A1 Dec. 18, 2008

(30) Foreign Application Priority Data

Jul. 19, 2005 (FR) ..... 10 2005 034 211

(51) Int. Cl.
*H01R 12/00* (2006.01)

(52) U.S. Cl. ..... 439/79; 439/80

(58) Field of Classification Search ..... 439/76.1, 439/79, 80

See application file for complete search history.

(56) References Cited

U.S. PATENT DOCUMENTS 5,658,155 A * 8/1997 McFarlane et al. ..... 439/79
5,688,130 A * 11/1997 Huang ..... 439/79
5,807,119 A * 9/1998 Baechtle et al. ..... 439/79
6,093,032 A * 7/2000 McHugh et al. ..... 439/79
6,979,206 B2 * 12/2005 Bu et al. ..... 439/79

FOREIGN PATENT DOCUMENTS

| | | |
|---|---|---|
| DE | 44 13 947 A1 | 10/1995 |
| DE | 199 22819 A1 | 11/2000 |
| DE | 199 55 437 A1 | 5/2001 |
| WO | WO 97/17741 | 5/1997 |

OTHER PUBLICATIONS

Anonymous: "Card and connector support post with plugging force control" Research Disclosure, Mason Publications, Hampshire, GB, Bd. 345, Nr. 92, Jan. 1993, XP007118612, ISSN: 0374-4353.

* cited by examiner

*Primary Examiner*—Thanh-Tam T Le
(74) *Attorney, Agent, or Firm*—McGlew and Tuttle, P.C.

(57) ABSTRACT

A double-row angle pin connector is provided for a patch plug that has an insertion direction that is parallel to the printed circuit board. The angle pin connector comprises angle pins (8) arranged in two rows in an inner, patch plug-side row (12) as well as in an outer row (13). The angle pins (8) have printed circuit board-side soldered ends (6) and patch plug-side plugged ends (5). The angle pin connector furthermore includes a housing bottom (14) and a housing cover (15) for fixing the angle pins (8). The soldered ends (6) arranged in the patch plug-side row (12) are fixed between the housing bottom (14) and the housing cover (15) by housing support straps (17) bent during the mounting of the housing. The arrangement provides reliably operating multi-pole patch plugs, without angle plugs with a separate extrusion coating, whereby installation space and costs can thus be saved.

24 Claims, 2 Drawing Sheets

DOUBLE-ROW ANGLE PIN CONNECTOR

CROSS REFERENCE TO RELATED APPLICATIONS

This application is a United States National Phase application of International Application PCT/DE2006/001152 and claims the benefit of priority under 35 U.S.C. §119 of German Patent Application DE 10 2005 034 211.6 filed Jul. 19, 2007, the entire contents of which are incorporated herein by reference.

FIELD OF THE INVENTION

The present invention pertains to an angle pin connector for an electronic printed circuit board for providing a patch plug parallel to the printed circuit board.

BACKGROUND OF THE INVENTION

Angle pin connectors of this class are typically arranged on an electronic board or printed circuit board and are used to establish a connection for receiving a multi-pole plug in the area of the printed circuit board, where the plug or the cable exiting from the plug exits from the angle pin connector in parallel to the surface of the printed circuit board for space reasons in the case being considered.

The connection pins of an angle pin connector have solder-side ends for connection to the strip conductors arranged on the printed circuit board as well as patch plug-side ends for receiving plug pins or contact prongs of an electrical connection plug. The patch plug-side ends are arranged in angle pin connectors at right angles to the soldered ends in order to thus make possible the desired exit direction of the connection plug or connection cable from the angle pin connector in parallel to the printed circuit board.

Besides the prior-art angle pin connectors, in which the connection pins or angle pins are arranged in a plug housing of their own, for example, extrusion-coated with a housing material, and in which the angle pins are thus held by the plug housing very firmly and immovably, multi-row angle pin connectors are also known, in which the specified spacings between the pins of the angle pins are maintained by a narrow strip only.

However, the latter angle pin connectors, though being especially inexpensive and, moreover, compact, have the drawback that the angle pins of such connectors are protected insufficiently against displacement of the patch plug-side ends in the axial direction of these ends. The forces that bring about such an axial displacement of the patch plug-side ends are especially plugging forces, which are transmitted during the plugging in or even during the pulling off of the corresponding electrical connection plugs. If these plugging forces exceed a certain value, the patch plug-side ends of the angle pins can be pushed into the angle pin connector in the prior-art angle pin connectors of a simple design.

Such excessively strong plugging forces may occur, for example, when contact pins or contact prongs are deformed, contaminated or corroded or when the plug is not moving exactly in parallel to the contact pins during insertion but is inserted in a tilted position. As a result, one or more of the angle pins may then be displaced by their corresponding counterpart in the plug from their desired position and bent.

However, such a deformation of connection pins is problematic because they may cause especially contact problems, and the intended flow of current is thus no longer reliably guaranteed in the deformed connection pins affected. The deformation of individual angle pins may even cause short-circuits in the area of the angle pin connector, especially when plug-side, inner angle pins are deformed to such an extent that they come into contact with the outer connection pins located at the same level in the other row.

It has not hitherto been possible in multi-row angle pin connectors to protect the connection pins arranged in the patch plug-side row or the soldered ends of these connection pins in a simple but effective manner against the displacement mentioned or from bending, because the pin row arranged on the patch plug side, i.e., the inner pin row, is precisely covered by the outer pin row. Therefore, only the angle pins of the outer pin row have hitherto been often supported, but the problem mentioned at the beginning, namely, the risk of bending during pushing in and possibly also during the pulling out of the plug, has continued to be present in the angle pins of the inner pin row.

SUMMARY OF THE INVENTION

Against this background, the object of the present invention is to provide an angle pin connector with which the drawbacks of the state of the art can be overcome. In particular, the angle pin connector shall be able to be designed such that it is especially reliable in operation also and precisely in case of the use of the, especially inexpensive and compact embodiments of angle pin connectors, which make do without extrusion coating of their own and without a plug housing of their own, and the axial displacements of connection pins caused by plug forces shall thus be reliably prevented from occurring.

The angle pin connector according to the present invention is used, initially in a manner known per se, to provide a plug connection in parallel to the printed circuit board. The angle pin connector comprises for this angled pins arranged in two rows with printed circuit board-side soldered ends and patch plug-side plugged ends, wherein the two rows comprise a patch plug-side, inner row as well as an outer row. The angle pin connector according to the present invention comprises, furthermore, a split housing for fixing the angle pins, the housing having a housing bottom and a housing cover.

However, the angle pin connector according to the present invention is characterized in that the soldered ends of the angle pins arranged in the inner, i.e., patch plug-side row are fixed between the housing bottom and the housing cover by means of housing support straps bent over during the mounting of the housing.

In other words, this means that, unlike in the state of the art, at most the soldered ends of the angle pins arranged in the outer row can be clamped and thus fixed between the housing bottom and the housing cover during the mounting of the housing. Thanks to the housing support straps according to the present invention, which surround the soldered ends arranged in the outer row in an arched manner and thus supportingly meet the soldered ends arranged in the inner, patch plug-side row, the soldered ends arranged in the inner row can rather also be clamped now between the housing bottom and the housing cover in a positive-locking manner and thus protected against displacement or bending.

This is especially advantageous because the present invention thus provides especially reliably operating and robust angle pin connectors, which, however, make do without an extrusion coating of their own or without a plug housing of their own in case of installation. The costs of embodying multi-pole plug-in connections that are of a high quality and meet high safety requirements to assembly units can thus be reduced by up to one order of magnitude.

The present invention is embodied independently from the particular design of the support straps and the particular housing component on which the support straps are arranged, as long as the reliable fixation of the soldered ends arranged in the inner pin row between the support straps and the other housing component is guaranteed.

According to a preferred embodiment of the present invention, the support straps are arranged, however, in the housing cover, while the plugged ends of the angle pins are arranged or fixed in the housing bottom. This makes it possible to arrange or preassemble all assembly units, including the printed circuit board carrying the angle pin connector, in the housing bottom. The housing cover is then finally mounted, and the support straps arranged in the housing cover surround the angle pins of the outer pin row and thus push and consequently fix the angle pins of the inner pin row into a corresponding contact with the housing bottom.

Furthermore, the manner in which the housing support straps surround the soldered ends of the angle pins arranged in the outer row or the manner in which the housing support straps are bent over during the mounting of the housing such that they meet the soldered ends of the angle pins arranged in the inner row is at first irrelevant for the embodiment of the present invention as long as reliable reproducibility is guaranteed. According to an especially preferred embodiment of the present invention, the patch plug-side housing component, i.e., for example, the housing bottom, does, however, have sloped sliding surfaces. The sloped sliding surfaces are used to bend the support straps arranged at the other housing component, i.e., for example, on the housing cover, in a controlled manner during the mounting of the housing.

Moreover, the front surfaces of the support straps are preferably also beveled corresponding to the sliding surfaces of the patch plug-side housing part. The support straps can thus slide down on the sloped sliding surfaces arranged, for example, on the housing bottom in a controlled manner at the moment of joining the housing bottom and the housing cover, as a result of which the linear motion occurring during the joining of the housing bottom and the housing cover is transformed into the lateral bending motion of the support straps, which bending motion is directed at right angles to the linear motion.

Furthermore, a double benefit arises in case of the beveled front surfaces of the support straps. On the one hand, an especially well controllable sliding of the support straps can take place on the sliding surfaces of the housing. On the other hand, an optimally fitting pressing surface is, in turn, obtained for fixing the soldered ends of the respective angle pins due to the beveled front surfaces of the support straps in the bent state of the latter.

According to another embodiment of the present invention, the support strap-side housing part, i.e., for example, the housing cover, comprises a stop surface for fixing the soldered ends of the angle pins arranged in the outer row. Not only the angle pins of the inner pin row, but also the outer pin row, consequently, in other words, all pins of the angle pin connector are fixed in this manner reliably and immovably between the housing halves or the housing parts.

The present invention is embodied independently from the size and the structural shape of the housing parts, as long as the arrangement of the support straps according to the present invention is implemented. However, according to an especially preferred embodiment of the present invention, at least one of the two housing parts, and preferably both housing parts, are formed by a component or a housing component each of a higher-level assembly unit. This is especially advantageous because multi-pole patch plugs can be embodied in this manner on assembly units in an especially simple and extremely inexpensive manner, for example, by the plug and jack contour as well as the mount of the angle pins are also integrated or extrusion-coated into the corresponding housing component.

However, the advantage according to the present invention, according to which not only the angle pins arranged in the outer row, but now also the angle pins located in the inner row are protected against displacement and bending, is fully preserved in case of such a plug contour integrated in the housing of the assembly unit, unlike in the state of the art.

To facilitate the preassembly of the angle pin connector, the angle pins may, furthermore, be arranged and fixed, as this is also provided for according to another, preferred embodiment of the present invention, in a common mounting or spacer strip. This facilitates the handling of the pins belonging to an angle pin connector as one unit and at the same time ensures compliance with the specified spaces between the pins before the final mounting.

The present invention will be explained in more detail below on the basis of drawings, which show exemplary embodiments only. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
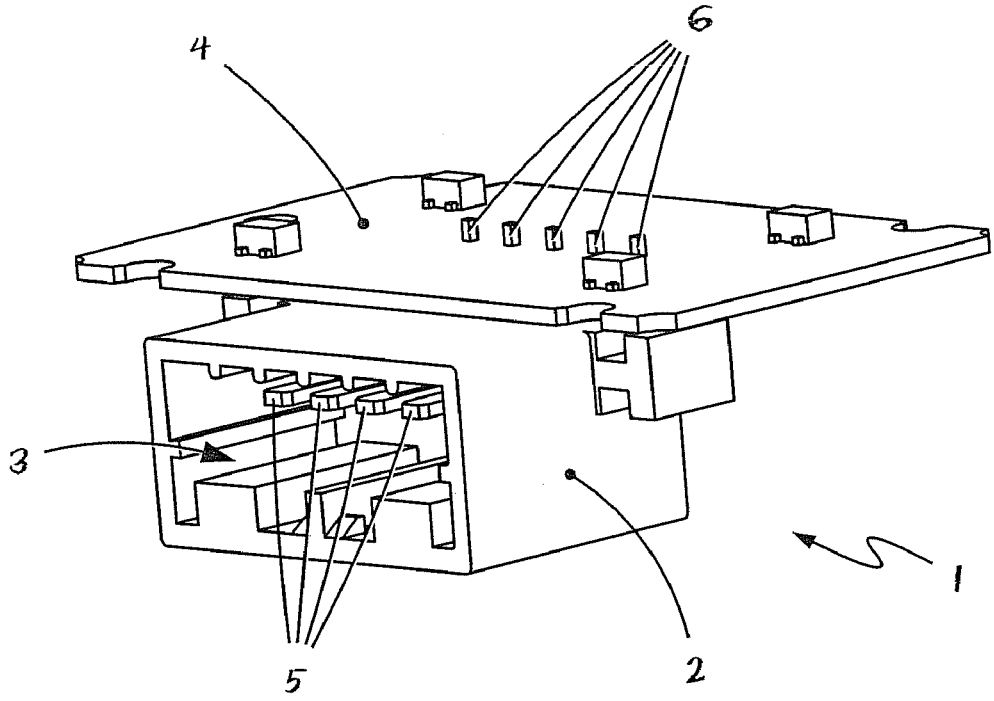
FIG. 1 is a schematic isometric view of an angle plug according to the state of the art.

Referring to the drawings in particular, FIG. 1 shows an isometric view of an angle plug 1 according to the state of the art. The plug pins 5, 6 or the angle pins are firmly extrusion-coated with a housing material 2 in the standard angle plug 1 being shown. The printed circuit board 4 as well as the angle pins with the patch plug-side ends 5 and with the soldered ends 6 passing through the printed circuit board are recognized next to the plug housing 2 with an inner contour 3 for receiving the plug of a cable harness.

Even though the angle plug 1 shown in FIG. 1 comprises only a single row of angle pins, angle pins with contact or angle pins arranged in two rows are, in principle, likewise formed usually by the extrusion coating of the angle pins with the housing material of the angle plug and thus they correspond, in principle, to the view shown in FIG. 1.

Angle plugs according to FIG. 1 have the advantage that all contact or angle pins are fixed immovably by the extrusion coating with the housing material 2 and especially protected against axial displacements of the patch plug-side ends 5 due to the plugging forces. Such angle plugs 1 according to FIG. 1 are consequently suitable, in principle, for establishing reliable multi-pole patch plugs between assembly units or between printed circuit boards 4 and cable harnesses.

Figure 2:
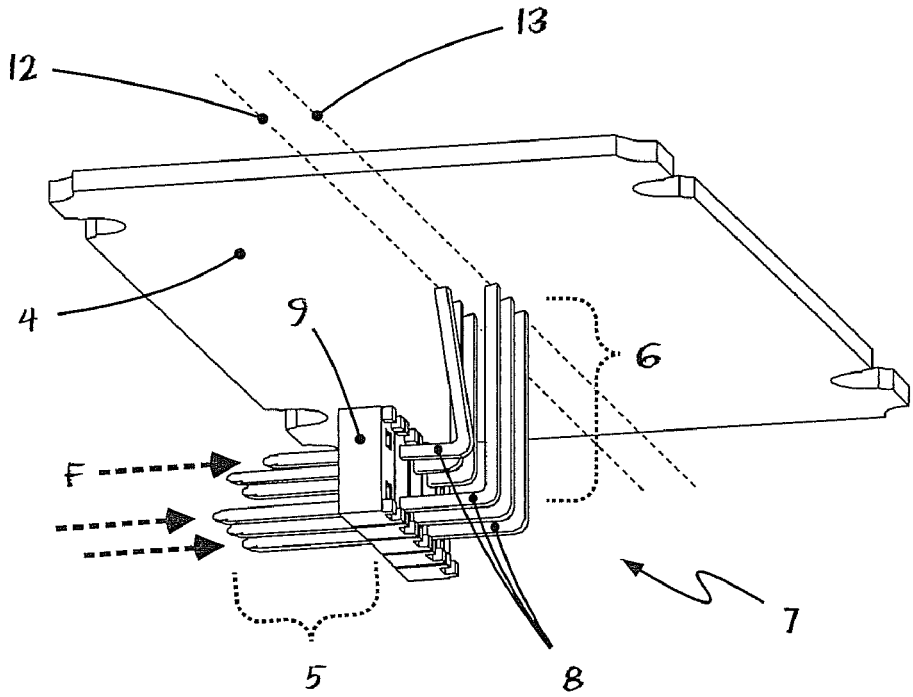
FIG. 2 is a view of an angle pin connector according to the state of the art corresponding to FIG. 1.

As was already stated in the introduction, such separately extrusion-coated angle plugs 1 are, however, comparatively expensive. Angle pin arrays 7 similar to the view in FIG. 2 are therefore frequently used for cost reasons. Such angle pin arrays 7 comprise essentially only the angle pins 8 proper, as well as a mounting strip 9, which ensures that the pins 8 belonging to one angle pin array 7 can be handled as one unit, and that the spaces between the contacts are maintained. Angle pin arrays 7 according to FIG. 2 have the advantage that they cause only a fraction of the cost that is associated with angle plugs according to FIG. 1. Furthermore, they require only an absolute minimum of space for their installation.

Figure 3:
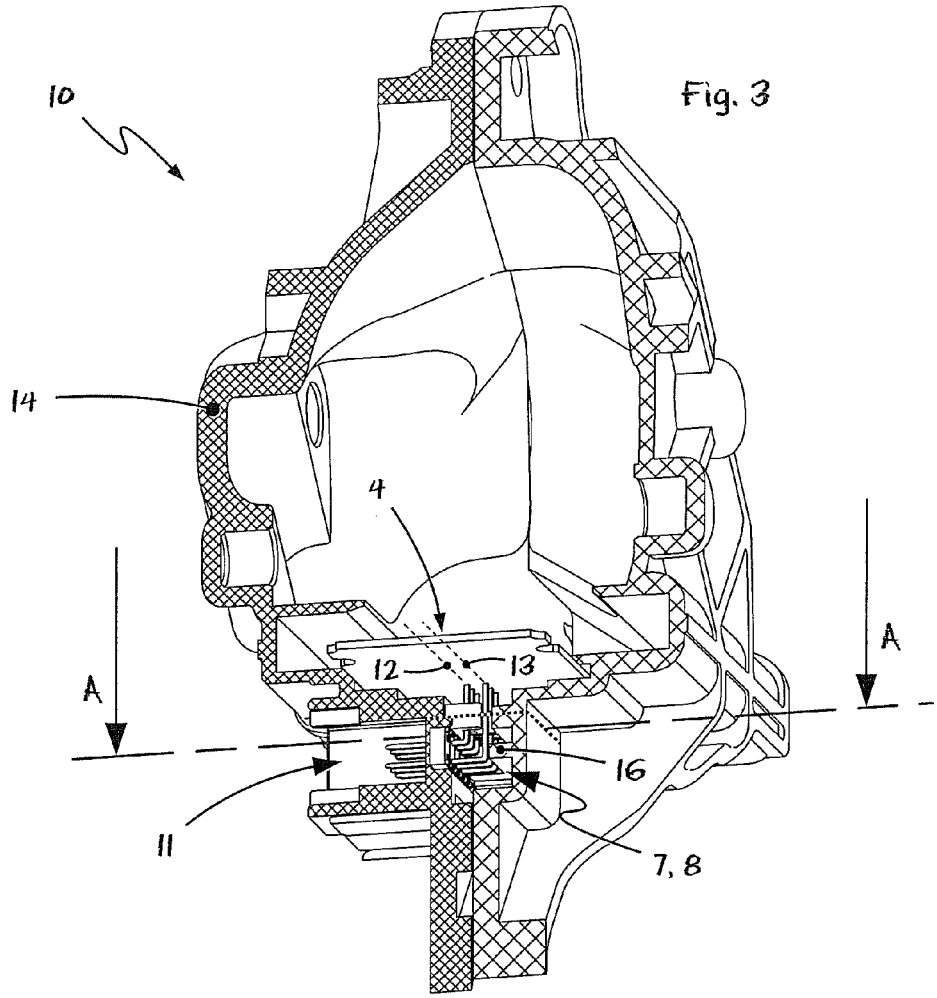
FIG. 3 is a schematic isometric and partially cutaway view of an assembly unit with an embodiment of an angle pin connector according to the present invention.

Angle pin arrays 7 according to FIG. 2 can be used, for example, in assembly units 10 similarly to the view in FIG. 3. The function of the plug housing 2, 3 of an angle plug 1, as it is shown in FIG. 1, will now be assumed in an angle pin array 7 according to FIG. 2 by a corresponding recess 11, which is made directly integrally on or in a housing component 14 of the assembly unit 10 (see FIG. 3).

However, there remains the problem described in the introduction, according to which the angle pins 8 located in the inner, patch plug-side row (see broken line 12) cannot be supported against axial displacements due to axial forces F. Such axial forces F or axial displacements of the plugged ends 5 of the angle pins 8, which displacements are caused thereby, may develop especially at the time when the corresponding cable harness plug (not shown) is plugged into the angle pin array 7, or also at the moment at which the cable harness or plug is being pulled off.

One of the angle pins 8 is shown for illustration in FIG. 2 in the state in which it is bent by the axial force F. It is seen that short-circuits may also develop between angle pins 8 arranged in different rows in case of further deformation, which may lead, just like the contact failures occurring because of the axial displacement of the plugged ends, to malfunctions of the assembly unit.

Figure 4:
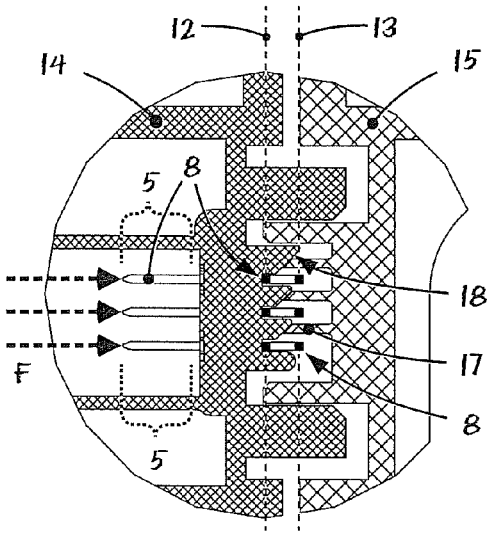
FIG. 4 is a schematic view of the angle pin connector according to FIG. 3 in a section A-A according to FIG. 3 before the mounting of the housing.
Figure 5:
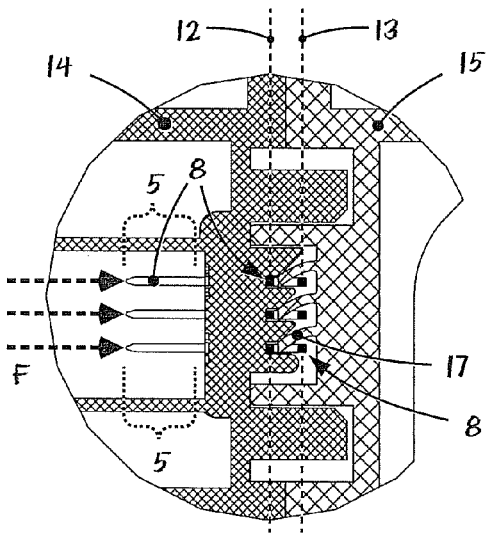
FIG. 5 is a view of an angle pin connector according to FIGS. 3 and 4 in a sectional view corresponding to FIG. 4 after the mounting of the housing.

The supporting of the angle pins 8 arranged in the inner row 12 is solved according to the present invention as shown in FIGS. 3 through 5. FIG. 3 shows a two-part housing 14, for an assembly unit 10 of, e.g., a motor vehicle. A printed circuit board 4 with an angle pin array 7 soldered into the printed circuit board is again recognized. The printed circuit board 4 and the angle pin array 7 are essentially the same as the components shown in FIG. 2.

It appears, furthermore, from the view in FIG. 3 that the jack 11 for receiving the plug of a cable harness is formed by the housing half 14 of the assembly unit 10, which is the left-hand housing part in the drawing, by the contour of the cable harness plug (not shown) being also integrated in an inverted position into the left-hand housing part 14 of the assembly unit 10. Costs are already saved as a result, and, furthermore, the space needed for installation is additionally reduced as well, because a separate extrusion-coated angle plug 1, as it is shown in FIG. 1, is no longer necessary.

The angle pin array 7 being used here has a double-row design. Supporting of the plugged ends 5 arranged in the jack recess 11 against displacements due to forces directed in the axial direction of the pin, which occur during the insertion of the cable harness plug, is assumed by a projection 16, which is made integrally in one piece with the housing half 15, which is the right-hand housing half in the drawing. However, the angle pins 8 of the inner pin row 12 are also protected according to the present invention against the insertion or bending due to plug forces, which is shown in FIG. 2, in the angle pin connector according to FIG. 3.

The design of the support used for this purpose for the angle pins 8 of the inner pin row 12 appears from FIGS. 4 and 5. FIGS. 4 and 5 show an enlarged area from the section plane A-A, which is indicated in FIG. 3 by the broken and dotted lines. Details of the two cut housing halves 14 and 15 are recognized in FIGS. 4 and 5. The two housing halves 14, 15 are still located at spaced locations from one another by a certain amount, before the final mounting, in FIG. 4, while the two housing halves 14, 15 in FIG. 5 have been brought together as a consequence of the mounting of the housing and are consequently in the assembled position.

The angle pins 8 are colored black in the area in which they pass through the section plane in FIGS. 4 and 5 for the sake of better recognizability. The housing support straps 17, which are arranged at the right-hand housing half 15 and are still in their straight starting position and initial shape according to FIG. 4 before the final joining of the two housing halves 14, 15, are visible in FIG. 4. Furthermore, the beveled sliding surfaces 18 of angle pin receiving regions are visible, which are arranged at the left-hand housing half 14 and whose slope angle corresponds to the bevels likewise present on the housing support straps 17 on the front side.

If the two housing halves 14, 15 are now joined together, the picture according to FIG. 5 is obtained. It is recognized that the support straps 17 arranged at the right-hand housing half 15 have slid down on the respective sliding surfaces 18 of the left-hand housing half 14, which said sliding surfaces are associated with them.

It is thus achieved that the support straps 17 surround the angle pins 8 arranged in the outer row 13, so that the front-side end surfaces of the support straps 17 come to lie in the area of the angle pins 8 arranged in the inner row 12. The angle pins 8 of the inner pin row 12 are thus enclosed in the respective depressions associated with them in the left-hand housing half 14, such that bending or displacement of the angle pins 8 arranged in the inner row 12 by the insertion forces F acting on the plugged ends 5 is no longer possible.

Thus, both the angle pins 8 arranged in the outer row 13 and the angle pins 8 arranged in the inner row 12 are effectively secured against bending caused by the plugging force (by the projection 16 according to FIG. 3 in the case of the angle pins 8 of the outer row 13 and by the bent support straps 17 in the case of the angle pins 8 of the inner row 12). An inexpensive solution, which is, however, reliable in operation, is thus obtained for the angle pin connection shown in FIG. 3, which is integrated in the housing, and the patch plug according to the present invention corresponds without restrictions to the considerably more expensive angle plug, as it is shown in FIG. 1, in terms of its performance and reliability.

Thus, it becomes clear as a result that an angle pin connector, with which the use of an expensive angle plug to form a multi-pole patch plug parallel to the printed circuit board becomes unnecessary, is provided by the present invention. Thus, the present invention provides reliably operating patch plugs while the costs are considerably reduced at the same time, and thus it makes a considerable contribution to cost reduction while the product quality remains high in the area of patch plugs, for example, in assembly units and systems in motor vehicles.

While specific embodiments of the invention have been shown and described in detail to illustrate the application of the principles of the invention, it will be understood that the invention may be embodied otherwise without departing from such principles.

The invention claimed is:

1. A double-row angle pin connector for providing a patch plug that is parallel to a printed circuit board, the angle pin connector comprising:

angle pins arranged in an inner patch plug-side row as well as in an outer row, said angle pins having printed circuit board-side soldered ends and having patch plug-side plug ends;

a housing including a housing bottom and a housing cover for fixing said angle pins, one of said housing bottom and said housing cover including housing support straps, said printed circuit board-side soldered ends of said angle pins being arranged in said patch plug-side row fixed between said housing bottom and said housing cover by means of said housing support straps in a bent state, said housing support straps being bent during the mounting of the housing, wherein said support straps supportingly meet said soldered ends arranged in said inner patch plug-side row; and wherein said housing support straps surround said soldered ends arranged in said outer row in an arched manner.

2. An angle pin connector in accordance with claim 1, wherein said patch plug-side plug ends of said angle pins are arranged in said housing bottom, whereas said support straps are arranged in said housing cover.

3. An angle pin connector in accordance with claim 1, wherein said housing bottom is a patch plug-side housing part with sloped sliding surfaces for the controlled bending of said support straps during the mounting of the housing.

4. An angle pin connector in accordance with claim 3, wherein front surfaces of said support straps are beveled corresponding to said sliding surfaces of said patch plug-side housing part.

5. An angle pin connector in accordance with claim 1, wherein one of said housing cover and said housing bottom including said housing support straps has a stop surface for fixing said printed circuit board-side soldered ends of said angle pins arranged in said outer row.

6. An angle pin connector in accordance with claim 1, wherein at least one of said housing bottom and said housing cover is formed by a component or housing of a higher-lever assembly unit or part of a larger assembly.

7. An angle pin connector in accordance with claim 1, further comprising a mounting strip, wherein said angle pins are arranged and fixed in said mounting strip.

8. An angle pin connector arrangement in accordance with claim 1, wherein said soldered ends arranged in said inner row are clamped between said housing bottom and said housing cover in a positive-locking manner via said support straps.

9. An angle pin connector arrangement in accordance with claim 1, wherein said support straps fix said angle pins of said inner row in contact with said housing bottom.

10. An angle pin connector arrangement in accordance with claim 9, wherein said support straps surround said angle pins of said outer row.

11. A double-row angle pin connector for providing a patch plug that has a plug insertion direction parallel to a printed circuit board, the angle pin connector comprising:

angle pins arranged in an inner patch plug-side row as well as in an outer row, said angle pins having printed circuit board-side soldered ends and having patch plug-side plug ends;

a housing including a housing bottom and a housing cover for fixing said angle pins, said housing bottom including pin receiving regions and said housing cover including housing support straps, said printed circuit board-side soldered ends of said angle pins being arranged in said patch plug-side row in respective receiving regions fixed between said housing bottom and said housing cover by means of said housing support straps in a bent state, said housing support straps being bent during the mounting of the housing, each end of one of said housing support straps being located opposite one of said soldered ends of one of said inner patch plug-side row angle pins such that each of said housing support straps fixes said one of said soldered ends of said one of said inner patch plug-side row angle pins in one of said receiving regions, at least a portion of one of said angle pins of said outer row being arranged between one of said housing support straps and another one of said housing support straps;

wherein said housing support straps surround said soldered ends arranged in said outer row in an arched manner.

12. An angle pin connector in accordance with claim 11, wherein said housing bottom defines a jack recess and said patch plug-side plug ends of said angle pins are arranged extending into said jack recess, whereas said support straps are arranged extending into a recess in said housing cover.

13. An angle pin connector in accordance with claim 11, wherein said housing bottom is a patch plug-side housing part with sloped sliding surfaces adjacent to each of said receiving regions for the controlled bending of said support straps during the mounting of the housing.

14. An angle pin connector in accordance with claim 13, wherein front surfaces of said support straps are beveled corresponding to said sliding surfaces of said patch plug-side housing part receiving regions.

15. An angle pin connector in accordance with claim 11, wherein said housing cover has a stop surface for fixing said printed circuit board-side soldered ends of said angle pins arranged in said outer row.

16. An angle pin connector in accordance with claim 11, wherein at least one of said housing bottom and said housing cover is formed by a component or housing of a higher-lever assembly unit or part of a larger assembly.

17. An angle pin connector in accordance with claim 11, further comprising a mounting strip, wherein said angle pins are arranged and fixed in said mounting strip.

18. A double-row angle pin connector arrangement comprising:

a printed circuit board;

angle pins arranged in an inner patch plug-side row as well as in an outer row, said angle pins having printed circuit board-side soldered ends soldered to said printed circuit board and having patch plug-side plug ends extending in parallel to said printed circuit board to define a plug insertion direction;

a housing for fixing said angle pins, said housing supporting said printed circuit board and including a housing bottom and a housing cover, said housing bottom including pin receiving regions and said housing cover including housing support straps, said printed circuit board-side soldered ends of said angle pins being arranged in said patch plug-side row in respective receiving regions fixed between said housing bottom and said housing cover by means of said housing support straps in a bent state, said housing support straps being bent during the mounting of the housing, each housing support strap being disposed in one of said receiving regions, each housing support strap engaging one of said soldered ends of one of said angled pins in said inner patch plug-side row such that said one of said soldered ends of one of said angled pins in said inner patch plug-side row is fixed in said one of said receiving regions;

wherein said housing support straps surround said soldered ends arranged in said outer row in an arched manner.

19. An angle pin connector in accordance with claim 18, wherein said housing bottom defines a jack recess and said patch plug-side plug ends of said angle pins are arranged extending into said jack recess, whereas said support straps are arranged extending into a recess in said housing cover.

20. An angle pin connector arrangement in accordance with claim 18, wherein said housing bottom is a patch plug-side housing part with sloped sliding surfaces adjacent to each of said receiving regions for the controlled bending of said support straps during the mounting of the housing.

21. An angle pin connector arrangement in accordance with claim 20, wherein front surfaces of said support straps are beveled corresponding to said sliding surfaces of said patch plug-side housing part receiving regions.

22. An angle pin connector arrangement in accordance with claim 18, further comprising a mounting strip, wherein said angle pins are arranged and fixed in said mounting strip.

23. An angle pin connector arrangement in accordance with claim 18, wherein said housing cover has a stop surface for fixing said printed circuit board-side soldered ends of said angle pins arranged in said outer row.

24. A double-row angle pin connector for providing a patch plug that is parallel to a printed circuit board, the angle pin connector comprising:

angle pins arranged in an inner patch plug-side row as well as in an outer row, said angle pins having printed circuit board-side soldered ends and having patch plug-side plug ends;

a housing including a housing bottom and a housing cover for fixing said angle pins, one of said housing bottom and said housing cover including housing support straps, said printed circuit board-side soldered ends of said angle pins being arranged in said patch plug-side row fixed between said housing bottom and said housing cover by means of said housing support straps in a bent state, said housing support straps being bent during the mounting of the housing, each of said housing support straps having a front surface, said front surface supportingly meeting one of said soldered ends of said angle pins arranged in said inner patch plug-side row;

wherein one or more of said housing support straps surrounds one of said soldered ends of said angle pins arranged in said outer row in an arched manner.

* * * * *